US010384451B2

(12) United States Patent
Ishibashi et al.

(10) Patent No.: US 10,384,451 B2
(45) Date of Patent: Aug. 20, 2019

(54) LIQUID DISCHARGE APPARATUS, IMPRINT APPARATUS, AND METHOD OF MANUFACTURING A COMPONENT

(71) Applicant: CANON KABUSHIKI KAISHA, Tokyo (JP)

(72) Inventors: Tohru Ishibashi, Saitama (JP); Yuichi Takahashi, Koshigaya (JP); Yoshimasa Araki, Yokohama (JP); Yutaka Mita, Utsunomiya (JP); Tsuyoshi Arai, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/562,143

(22) PCT Filed: May 9, 2016

(86) PCT No.: PCT/JP2016/064406
§ 371 (c)(1),
(2) Date: Sep. 27, 2017

(87) PCT Pub. No.: WO2016/190143
PCT Pub. Date: Dec. 1, 2016

(65) Prior Publication Data

US 2018/0079215 A1 Mar. 22, 2018

(30) Foreign Application Priority Data

May 22, 2015 (JP) ..... 2015-104762

(51) Int. Cl.
*B41J 2/165* (2006.01)
*B05C 5/02* (2006.01)
(Continued)

(52) U.S. Cl.
CPC ..... *B41J 2/16505* (2013.01); *B05C 5/027* (2013.01); *B05C 9/12* (2013.01); *B05C 11/1039* (2013.01); *B41J 2/165* (2013.01); *B41J 2/1652* (2013.01)

(58) Field of Classification Search
CPC .. B41J 2/16505; B05C 5/027; B05C 11/1039; B05C 9/12
See application file for complete search history.

(56) References Cited

U.S. PATENT DOCUMENTS 3,647,138 A 3/1972 Houser
5,250,962 A 10/1993 Fisher et al.
(Continued)

FOREIGN PATENT DOCUMENTS

CN 102046386 A 5/2011
CN 102196916 A 9/2011
(Continued)

OTHER PUBLICATIONS ip.com search.*
(Continued)

*Primary Examiner* — Lisa Solomon
(74) *Attorney, Agent, or Firm* — Venable LLP

(57) ABSTRACT

Provided is a liquid discharge apparatus, including: a head having an discharge port surface in which an discharge port array is provided, the discharge port array including a plurality of discharge ports which discharges liquid and is arranged along a first direction; a suction port performing a suction operation for the discharge port surface; and a control unit causing the suction port to move in a second direction intersecting the first direction under a state in which the suction port is spaced away from the discharge port surface.

17 Claims, 7 Drawing Sheets

(51) Int. Cl.
*B05C 9/12* (2006.01)
*B05C 11/10* (2006.01)

(56) References Cited

U.S. PATENT DOCUMENTS

| | | | |
|---|---|---|---|
| 6,412,905 | B1 | 7/2002 | Lin |
| 9,096,064 | B2 | 8/2015 | Tone |
| 9,493,004 | B2 | 11/2016 | Ishibashi et al. |
| 2003/0016264 | A1 | 1/2003 | Jeanmaire |
| 2008/0186352 | A1 | 8/2008 | Sasayama |
| 2009/0303283 | A1 | 12/2009 | Nakano et al. |
| 2010/0182370 | A1 | 7/2010 | Nemoto et al. |
| 2015/0097900 | A1 | 4/2015 | Araki et al. |

FOREIGN PATENT DOCUMENTS

| | | | |
|---|---|---|---|
| JP | 2000062197 | A | 2/2000 |
| JP | 2004-174845 | A | 6/2004 |
| JP | 2006137178 | A | 6/2006 |
| JP | 2008-188930 | A | 8/2008 |
| JP | 2008188932 | A | 8/2008 |
| JP | 2009023118 | A | 2/2009 |
| JP | 2010240526 | A | 10/2010 |
| JP | 2011-192917 | A | 9/2011 |
| JP | 2013237167 | A | 11/2013 |
| JP | 2015092549 | A | 5/2015 |
| KR | 10-2015-0000829 20 | | 1/2015 |
| TW | 499367 | B | 8/2002 |
| TW | 201102276 | A | 1/2011 |

OTHER PUBLICATIONS

IP.com search (Year:2019).*
Taiwanese IPO Office Action and Search Report dated Mar. 9, 2017, in Taiwan Invention Patent Appln. No. 105113729.
Office Action issued in corresponding Singapore Application No. 11201708843W dated Mar. 8, 2018.
International Search Report and Written Opinion of Parent International Application No. PCT/JP2016/064406 dated Oct. 19, 2016.
Taiwanese IPO Office Action and Search Report dated Sep. 2, 2017, in Taiwan Invention Patent Appln. No. 105113729.
International Preliminary Report on Patentability issued in Patent Application No. PCT/JP2016/064406, dated Dec. 7, 2017.
U.S. Appl. No. 15/562,124, filed Sep. 27, 2017 (First Named Inventor: Kensuke Tone).
Chinese Office Action issued in corresponding Chinese Application No. 201680029775.9 dated Oct. 9, 2018.
Korean Office Action issued in corresponding Korean Application No. 10-2017-7036038 dated Apr. 29, 2019.
Japanese Office Action issued in corresponding Japanese Application No. 2015104762 dated May 21, 2019.

* cited by examiner

LIQUID DISCHARGE APPARATUS, IMPRINT APPARATUS, AND METHOD OF MANUFACTURING A COMPONENT

TECHNICAL FIELD

The present invention relates to a liquid discharge apparatus including a liquid discharge head configured to discharge liquid, an imprint apparatus, and to a method of manufacturing a component.

BACKGROUND ART

There is known a liquid discharge apparatus including a liquid discharge head (hereinafter referred to simply as "head") having discharge ports (hereinafter referred to as "nozzles") configured to discharge liquid. In recent years, this liquid discharge apparatus is used in various fields, for example, as an ink-jet recording apparatus.

In order to maintain discharge characteristics of the liquid discharge head of the liquid discharge apparatus, it is necessary to remove (cleaning operation) adhering matter (foreign matter such as liquid or residue) adhering onto a nozzle surface on which the nozzles are formed. For example, in Patent Literature 1 (see FIG. 9), there is disclosed a configuration using an air blow nozzle 204 to remove adhering matter adhering onto a nozzle surface 203 on which nozzles 202 of an ink-jet head 201 are formed.

Specifically, in Patent Literature 1, air is blown into the nozzle surface 203 from the air blow nozzle 204 moving along a movement direction, to thereby move (remove) the adhering matter adhering onto the nozzle surface 203. Further, the adhering matter moved by the air blow nozzle 204 is collected by an air suction nozzle 205 arranged away from the nozzle surface 203.

The nozzles may often be arranged in arrays on the nozzle surface. For example, as illustrated in FIG. 10A to FIG. 10C, a plurality of nozzles is arranged along a first direction in a first array 202*a* and a second array 202*b* on the nozzle surface 203. When the nozzle surface 203 is cleaned, the air blow nozzle 204 is configured to blow air while moving along the first direction, to thereby remove foreign matter 30(*a*) and foreign matter 30(*b*).

CITATION LIST

Patent Literature

PTL 1: Japanese Patent Application Laid-Open No. 2004-174845

When the air blow nozzle 204 is moved from left to right along the first direction during the cleaning operation, the air blow nozzle 204 passes through regions in front of two or more nozzles 202. Thus, even when the foreign matter 30(*a*) generated at the nozzle 202 on an upstream side in the movement direction is moved toward a downstream side by the air blow nozzle 204, the foreign matter 30(*a*) may enter the nozzle 202 on the downstream side again. That is, the foreign matter generated at the nozzle on the upstream side may soil the nozzle on the downstream side due to the cleaning operation adversely.

SUMMARY OF INVENTION

It is an object of the present invention to provide a liquid discharge apparatus capable of efficiently removing adhering matter on a discharge port surface.

It is another object of the present invention to provide a liquid discharge apparatus, including: a head having a discharge port surface in which a discharge port array is provided, the discharge port array including a plurality of discharge ports which discharges liquid and is arranged along a first direction; a suction port performing a suction operation for the discharge port surface; and a control unit causing the suction port to move in a second direction intersecting the first direction under a state in which the suction port is spaced away from the discharge port surface.

It is another object of the present invention to provide an imprint apparatus, including: a head having a discharge port surface in which a discharge port array is provided, the discharge port array including a plurality of discharge ports which discharges liquid and is arranged along a first direction; a suction port performing a suction operation for the discharge port surface; a control unit causing the suction port to move in a second direction intersecting the first direction under a state in which the suction port is spaced away from the discharge port surface; and a patterning unit forming a pattern corresponding to a concavo-convex pattern of a mold on one surface of a substrate by bringing the one surface of the substrate having the liquid discharged thereto with the head and a surface of the mold having the concavo-convex pattern formed thereon into abutment against each other.

It is another object of the present invention to provide a method of manufacturing a component including a substrate through use of an imprint apparatus, the imprint apparatus including: a head having a discharge port surface in which a discharge port array is provided, the discharge port array including a plurality of discharge ports which discharges liquid and is arranged along a first direction; and a suction port, the method including: performing a suction operation for the discharge port surface by moving the suction port in a second direction intersecting the first direction under a state in which the suction port is spaced away from the discharge port surface; applying the liquid to a surface of the substrate with the head after the suction operation; forming a pattern corresponding to a concavo-convex pattern of a mold on the surface of the substrate by bringing the surface of the substrate having the liquid applied thereto and a surface of the mold having the concavo-convex pattern formed thereon into abutment against each other; and processing the substrate having the pattern formed thereon.

Further features of the present invention will become apparent from the following description of exemplary embodiments with reference to the attached drawings.

DESCRIPTION OF EMBODIMENTS

Preferred embodiments of the present invention will now be described in detail in accordance with the accompanying drawings.

First Embodiment

Now, a first embodiment of the present invention is described with reference to FIG. 1 to FIG. 5. In the first embodiment, an ink-jet recording apparatus configured to discharge ink (hereinafter referred to as "discharge apparatus") is described as an example of a liquid discharge apparatus of the present invention. The "ink" to be used in the discharge apparatus of the first embodiment is an example of "liquid" to be used in the liquid discharge apparatus of the present invention.

Figure 1:
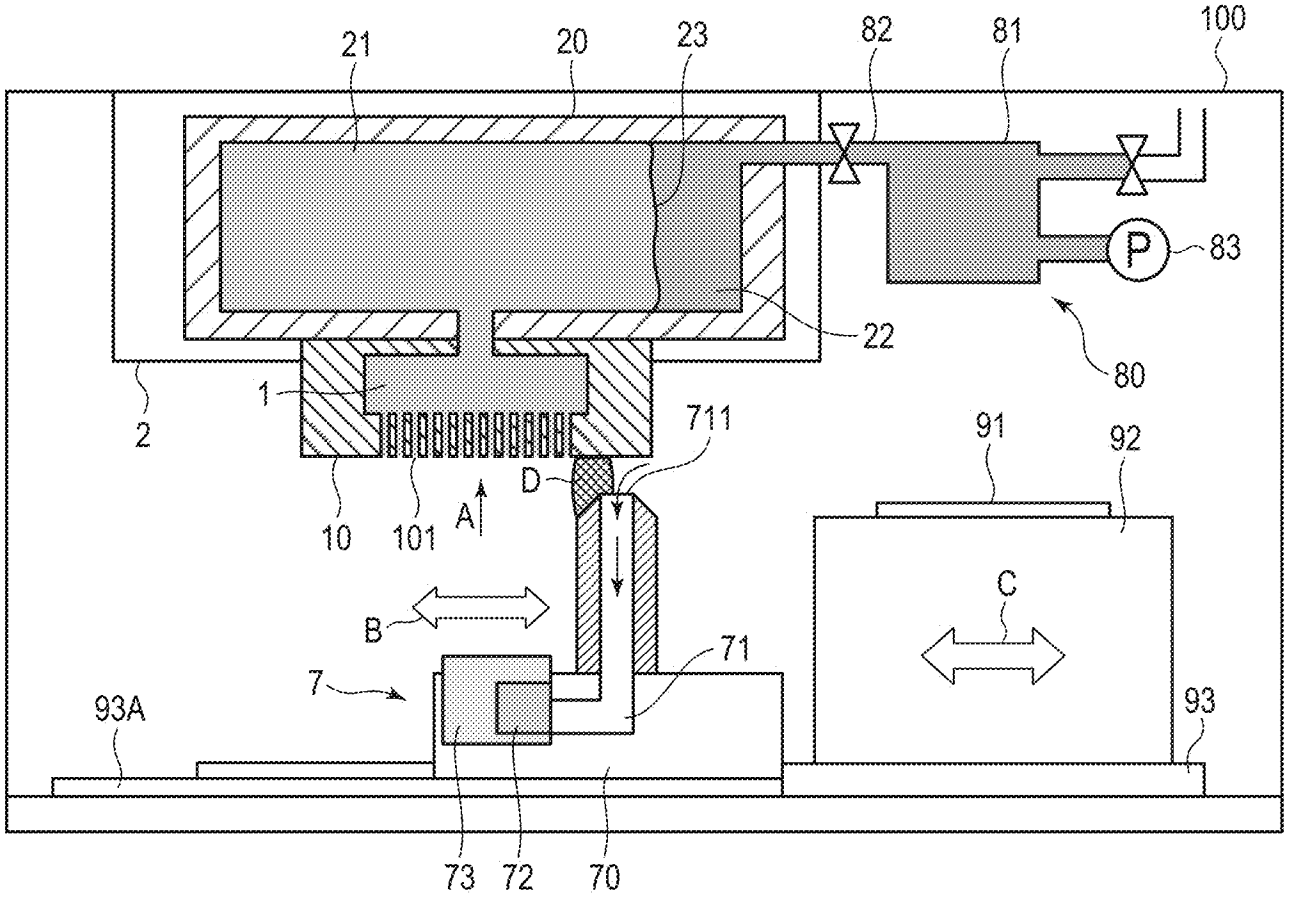
FIG. 1 is a conceptual diagram of a liquid discharge apparatus according to a first embodiment of the present invention.

FIG. 1 is a conceptual diagram of the discharge apparatus (liquid discharge apparatus) of the first embodiment.

As illustrated in FIG. 1, in the first embodiment, a discharge apparatus 100 mainly includes a head 1 configured to discharge ink (liquid), a first tank 2 containing the ink, and a pressure regulation unit 80. The discharge apparatus 100 further includes a conveyance unit 92 configured to convey a recording medium 91, and a support portion 93 configured to support the conveyance unit 92. The recording medium 91 is held on the conveyance unit 92 through suction by a suction unit (not shown).

Figure 3:
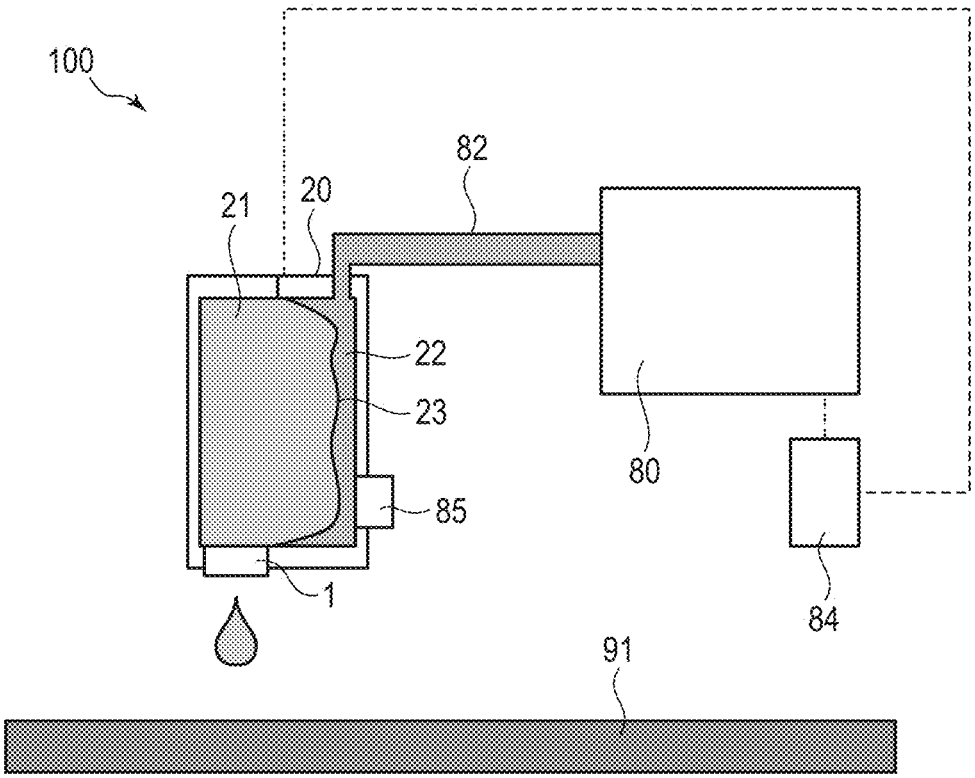
FIG. 3 is a conceptual diagram of a state during a liquid discharge operation of the liquid discharge apparatus according to the first embodiment of the present invention.

In the first embodiment, the head 1, the conveyance unit 92, the suction unit, the pressure regulation unit 80, and other mechanisms are controlled by a control unit 84 (see FIG. 3). The control unit may be constructed of, for example, a CPU.

The first tank 2 includes a rectangular parallelepiped casing 20 in a substantially sealed state, and the head 1 is mounted on a bottom of the casing 20. The first tank 2 has no atmosphere communication port. On a bottom surface of the casing 20, the head 1 has a discharge port surface 10 on which discharge ports 101 are formed.

Inside the casing 20, a flexible film 23 (flexible portion) having flexibility is formed in a vertical direction, to thereby partition an internal space of the first tank 2 into a first chamber 21 and a second chamber 22. The first chamber 21 communicates to the inside of the head 1 mounted on the bottom of the casing 20, and contains the ink to be supplied to the head 1. The second chamber 22 communicates to the pressure regulation unit 80, and contains working liquid.

The pressure regulation unit 80 includes a working liquid buffer portion 81, a communication channel 82, and a pump 83. The working liquid buffer portion 81 communicates to the second chamber 22 through the communication channel 82.

The pressure regulation unit 80 further includes a pressure sensor (not shown) configured to detect a pressure in the working liquid buffer portion 81. An on-off valve capable of switching the channel between an opened state and a closed state is provided to the communication channel 82.

In the first embodiment, the first chamber 21 is filled with the ink, whereas the second chamber 22 is filled with the working liquid. Each of the working liquid buffer portion 81 and the communication channel 82 is also filled with the working liquid. Thus, the working liquid buffer portion 81 and the head 1 are configured such that the pressure is transmissible therebetween. Therefore, the pressure in the working liquid buffer portion 81 is detected through use of the pressure sensor so that information on the pressure in the head 1 can be obtained.

The pump 83 is provided to the working liquid buffer portion 81. The pressure in the working liquid buffer portion 81 can be regulated through actuation of the pump 83. That is, the pressure regulation unit 80 (pump 83) is capable of freely controlling the pressure in the head 1 through pressurization or depressurization. A drive mechanism (not shown) configured to drive the pump 83 is controlled by the control unit.

The pressure regulation unit 80 may include a working liquid supply portion (not shown) configured to supply the working liquid to the second chamber 22. That is, when the ink in the first tank 2 (first chamber 21) is consumed through discharge of the ink from the head 1 during a recording operation, the volume of the ink in the first chamber 21 is decreased. Along with the decrease in volume of the ink, the flexible film 23 is deformed so that the volume of the second chamber 22 is increased. Through the supply (replenishment) of the working liquid to the second chamber 22 by the working liquid supply portion, the pressure in the system can be maintained more stably.

In the first embodiment, liquid having a density substantially equal to that of the ink in the first chamber 21 is employed as the working liquid in the second chamber 22. The working liquid and the ink (liquid to be discharged) are substantially equal in density, and hence the pressure in the head 1 can be controlled more stably. The working liquid is a substance having incompressibility. For example, liquid such as water or a gel-like substance may be used as the working liquid.

In the first embodiment, a cleaning unit 7 is a mechanism configured to clean the discharge port surface 10 of the head 1 so as to maintain (recover) the discharge performance of the discharge apparatus 100.

Specifically, as illustrated in FIG. 1, the cleaning unit 7 includes a suction nozzle 71 (suction port), a suction fan 72 (pressure control unit), and a liquid receiving portion 73. The cleaning unit 7 further includes a conveyance unit 70 configured to convey the suction nozzle 71, and a support portion 93A configured to support the conveyance unit 70.

The conveyance unit 70 is controlled by the control unit. The pressure in the suction nozzle 71 (in the suction port) is controlled by the suction fan 72. The pressure in the suction nozzle 71 may be set within a range of, for example, from −0.05 kPa to −0.5 kPa.

In the first embodiment, the suction nozzle 71 is arranged in the vertical direction. Further, the suction nozzle 71 is arranged so that a predetermined distance is secured between an opening surface 711 of the suction nozzle 71 and the discharge port surface 10 of the head 1 when performing a suction operation for the discharge port surface 10. The predetermined distance may be set within a range of, for example, from 0.1 mm to 1.0 mm.

The suction nozzle 71 is movable along the discharge port surface 10 by the conveyance unit 70. Thus, the suction nozzle 71 can suck (remove) liquid or adhering matter on the discharge port surface 10 along with its movement. The moving speed of the suction nozzle 71 may be set within a range of, for example, from 1 mm/sec to 10 mm/sec.

Figure 2:
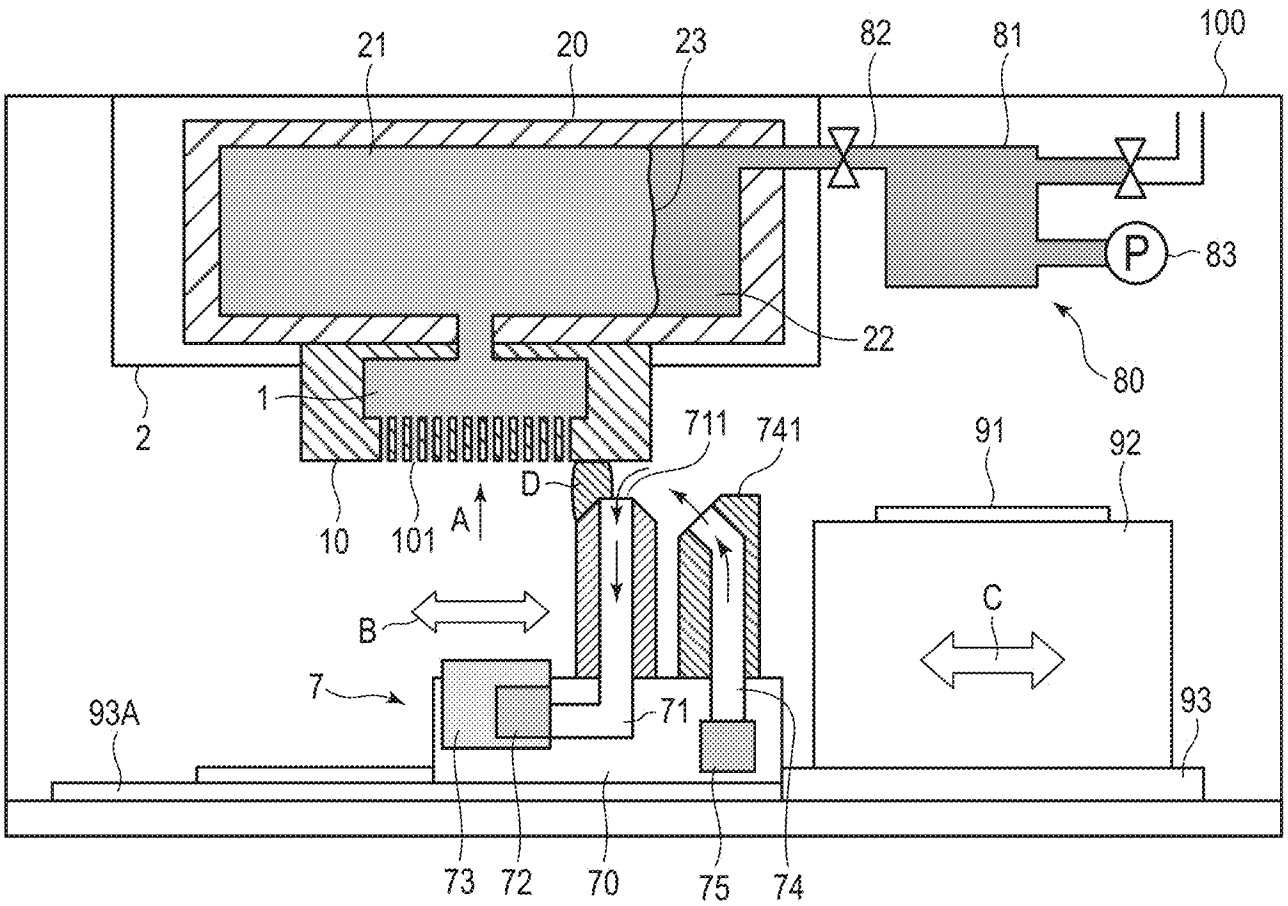
FIG. 2 is a conceptual diagram of a modified example of the liquid discharge apparatus according to the first embodiment of the present invention.

FIG. 2 is an illustration of a modified example of the cleaning unit 7 of the discharge apparatus according to the first embodiment.

As illustrated in FIG. 2, the cleaning unit 7 may further include a blow nozzle 74 (blow port) and a blow fan 75 (pressure control unit), which are configured to blow compressed air. The blow nozzle 74 may be arranged in the vicinity of the suction nozzle 71. The pressure in the blow nozzle 74 (in the blow port) is controlled by the blow fan 75.

For example, the blow nozzle 74 may be arranged in the vicinity of the suction nozzle 71 so as to be located behind the suction nozzle 71 in its movement direction during the suction operation. Further, an opening surface 741 of the blow nozzle 74 may be provided so as to be inclined toward the suction nozzle 71. Thus, the contact angle between the discharge port surface 10 and each ink droplet can be increased, thereby being capable of moving and removing the adhering matter on the discharge port surface 10 more easily.

The pressure in the blow nozzle 74 may be set within a range of, for example, from +0.01 kPa to +0.5 kPa.

FIG. 3 is an illustration of a state during the recording operation (ink discharge operation) of the discharge apparatus according to the first embodiment. As illustrated in FIG. 3, the pressure regulation unit 80 is controlled by the control unit 84 (CPU). Thus, the inside of the head 1 is stably maintained in a state of negative pressure during the recording operation.

The recording operation is performed through the discharge of the ink (liquid) onto the recording medium by the head 1. In the first embodiment, an abnormality detection unit 85 is provided to the first tank 2, thereby being capable of detecting an abnormality of the discharge apparatus 100.

Now, a relationship between the arrangement of the discharge ports on the discharge port surface and the movement direction of the suction nozzle 71 is described with reference to FIG. 4 and FIG. 5.

Figure 4:
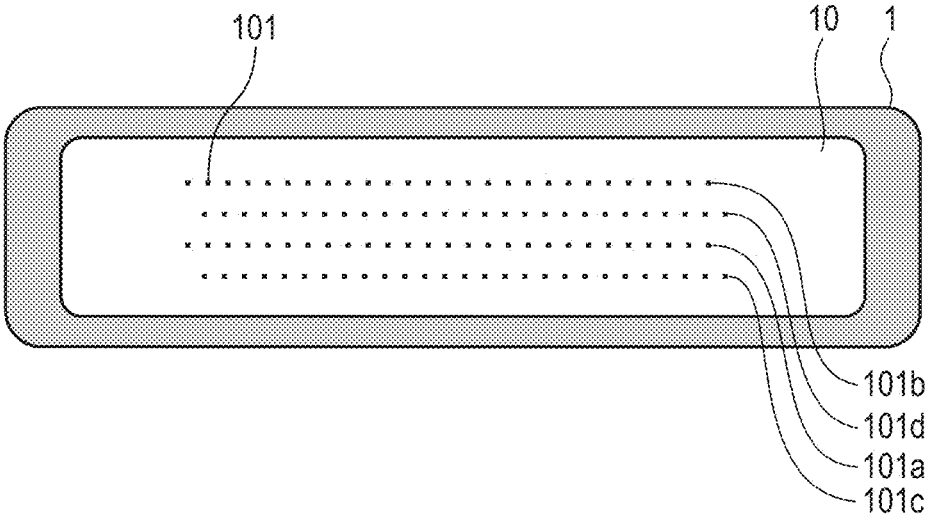
FIG. 4 is a conceptual diagram of a discharge port surface of the liquid discharge apparatus according to the first embodiment of the present invention.

FIG. 4 is a conceptual diagram of the discharge port surface 10 of the discharge apparatus according to the first embodiment. FIG. 4 is an illustration of a state of the discharge port surface 10 when viewed in a direction of the arrow A illustrated in FIG. 2.

Figure 5:
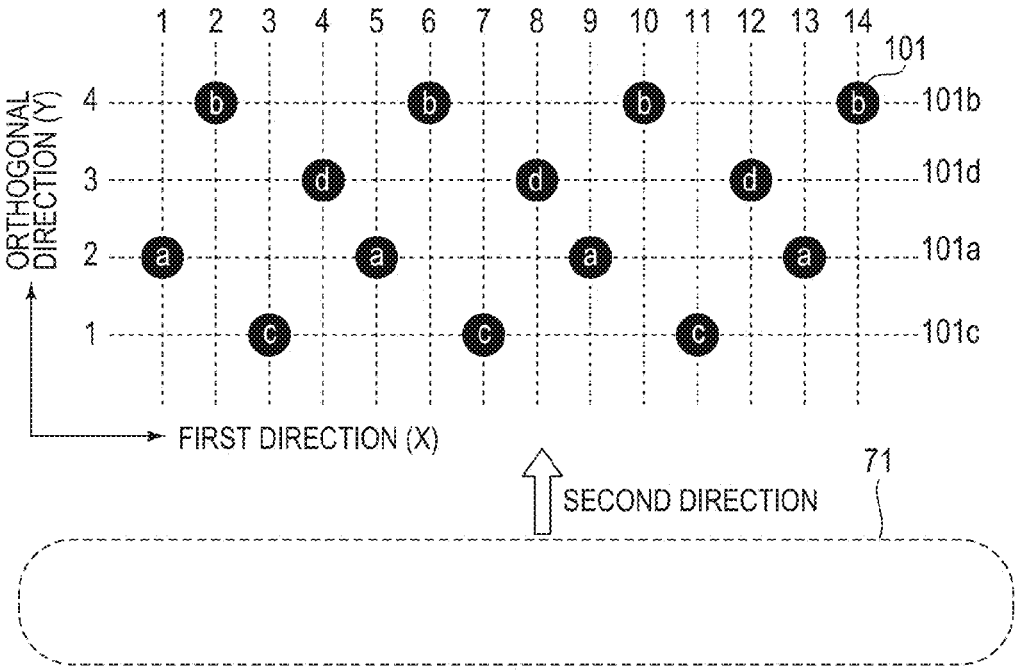
FIG. 5 is a conceptual diagram of a relationship between arrangement of discharge ports and a movement direction of a suction port according to the first embodiment of the present invention.

FIG. 5 is a conceptual diagram of the relationship between the arrangement of the discharge ports 101 and the movement direction of the suction nozzle 71 according to the first embodiment.

As illustrated in FIG. 5, the discharge port surface 10 includes discharge port arrays (101*c*, 101*a*, 101*d*, 101*b*), in each of which a plurality of discharge ports 101 configured to discharge the ink (liquid) is arranged along a first direction (X). That is, the plurality of discharge ports 101 forming the four discharge port arrays (101*c*, 101*a*, 101*d*, 101*b*) is arranged on the discharge port surface 10 in a staggered pattern. In the first embodiment, the discharge ports of the same array are arranged at equal intervals, and the respective discharge port arrays are also arranged at equal intervals.

Specifically, the discharge port arrays, in each of which the plurality of discharge ports 101 is arrayed along the first direction (X), are further arrayed on the discharge port surface 10 in an order of a first array 101*c*, a second array 101*a*, a third array 101*d*, and a fourth array 101*b* along a direction (Y) orthogonal to the first direction. That is, a plurality of discharge port arrays (101*c*, 101*a*, 101*d*, 101*b*) is arranged on the discharge port surface 10.

As illustrated in FIG. 5, when viewed in the orthogonal direction (Y) (i.e. a second direction), the discharge ports 101 of the first to fourth arrays are arranged at non-overlapping positions.

In the first embodiment, the suction nozzle 71 is moved by the conveyance unit 70 in the second direction corresponding to the direction (Y) orthogonal to the first direction (X). That is, the suction nozzle 71 is moved along the second direction to perform the suction operation for the first array 101*c*, the second array 101*a*, the third array 101*d*, and the fourth array 101*b* in the stated order.

As understood from FIG. 5, portions of the suction nozzle 71, which pass through regions in front of discharge ports (c) of the first array 101*c* (that is, positions opposed to the discharge ports), and portions of the suction nozzle 71, which pass through regions in front of discharge ports (a) of the second array 101*a*, are different from each other.

That is, the portions of the suction nozzle 71, which have passed through the regions in front of the discharge ports (c) of the first array 101*c*, pass through regions in front of positions where the discharge ports (a) of the second array 101*a* are not arranged (that is, positions opposed to positions where the discharge ports are not arranged).

The portions of the suction nozzle 71, which have passed through the regions in front of the discharge ports (c, a) of the first array 101*c* and the second array 101*a*, further pass through regions in front of positions where discharge ports (d) of the third array 101*d* are not arranged.

Then, the portions of the suction nozzle 71, which have passed through the regions in front of the discharge ports (c, a, d) of the first array 101*c*, the second array 101*a*, and the third array 101*d*, pass through regions in front of positions where discharge ports (b) of the fourth array 101*b* are not arranged.

When viewed in the second direction, the discharge ports 101 of the first to fourth arrays are arranged at the non-overlapping positions. Therefore, the same portion of the suction nozzle 71 does not pass through the regions in front of two or more discharge ports. Thus, the adhering matter generated at the discharge port on an upstream side does not soil the discharge port on a downstream side. Accordingly, the discharge port surface can be cleaned efficiently.

In the first embodiment, the second direction corresponding to the movement direction of the suction nozzle 71 is set to the direction orthogonal to the first direction, but the second direction need not be the orthogonal direction. That is, the second direction may be set at a predetermined angle with respect to the direction (Y) orthogonal to the first direction (X) as long as a predetermined portion of the suction nozzle 71, which has passed through a region in front of an arbitrary discharge port 101 of the first array 101*c*, does not pass through a region in front of an arbitrary discharge port 101 of each of the second array 101*a* to the fourth array 101*b*. The predetermined angle may be calculated based on a distance between adjacent discharge ports in the same discharge port array and a distance between adjacent discharge port arrays.

In the first embodiment, the length (opening width) of the suction nozzle 71 is set equal to or larger than the length of the discharge port array. Thus, the discharge port surface 10 can be cleaned by the suction nozzle 71 through one movement operation of the conveyance unit 70. When the length of the suction nozzle 71 is smaller than the length of the discharge port array, the discharge port surface 10 may be cleaned through a plurality of times of movement operation.

The control unit 84 is configured for causing the suction nozzle 71 to move in the second direction intersecting the first direction under a state in which the suction nozzle 71 is spaced away from the discharge port surface 10, thereby being capable of removing the adhering matter such as the ink on the discharge port surface 10.

In the first embodiment, before the cleaning operation (suction operation) is performed, the pressure in the head may be changed in a positive pressure direction with respect to the pressure that is set during the discharge operation (negative pressure). Thus, the state of a meniscus of the ink on the discharge port surface 10 can be changed from "concave" to "convex". Accordingly, when the cleaning operation (suction operation) is performed, the entry of the adhering matter into the discharge port 101 is further suppressed, thereby being capable of removing the adhering matter more effectively.

In the first embodiment, the first tank 2 (first chamber 21 and second chamber 22) is filled with the ink and the working liquid having densities close to each other. Therefore, even when any impact occurs in the casing 20, vibration is suppressed effectively. As a result, the inside of the head 1 is stably maintained in the state of negative pressure.

In the first embodiment, the flexible film 23 is connected to the upper surface, the lower surface, and the side surfaces of the casing, to thereby partition the casing to form the first chamber 21 and the second chamber 22. However, the flexible film 23 may be arranged in another way. For example, the flexible film 23 may be arranged in the casing 20 so that the first chamber 21 containing the ink is substantially surrounded by the second chamber 22 containing the working liquid. That is, the flexible film 23 may be arranged in the casing 20 so that the first chamber 21 (space) containing the ink is surrounded by the flexible film 23.

From the viewpoint of a liquid contact property and other factors, it is preferred that a member suited to the properties of the ink (liquid contained in the first chamber) be selected for the flexible film 23 to be used in the first embodiment.

In the first embodiment, the configuration in which the head 1 is integrally mounted on the lower part of the casing 20 of the first tank 2 is described. However, the head 1 and the first tank 2 may be constructed separately, and the head 1 and the first tank 2 (first chamber 21) may be connected to each other through use of a connection tube.

In the first embodiment, a joint portion may be provided to the channel (communication channel 82) between the first tank (second chamber 22) and the pressure regulation unit 80 so that the first tank 2 and the pressure regulation unit 80 are separable (removable) from each other.

In the first embodiment, the liquid discharge apparatus is described by taking the ink-jet recording apparatus configured to discharge the ink as an example. However, the present invention may be modified and applied as appropriate to, for example, a liquid discharge apparatus configured to discharge liquid such as conductive liquid or UV curable liquid.

Second Embodiment

Now, a second embodiment of the present invention is described with reference to FIG. 6.

In the second embodiment, similarly to the first embodiment, an ink-jet recording apparatus (hereinafter referred to as "discharge apparatus") is described as an example of the liquid discharge apparatus.

Figure 6:
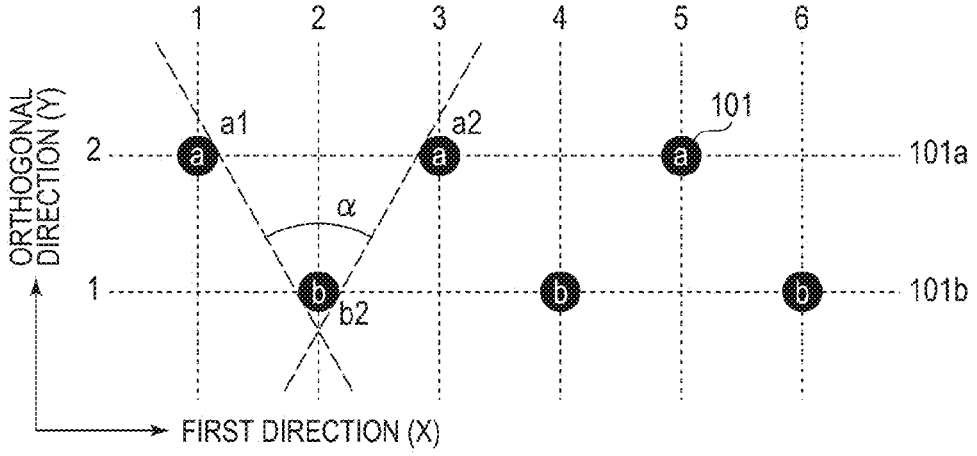
FIG. 6 is a conceptual diagram of a relationship between arrangement of discharge ports and a movement direction of a suction port in a liquid discharge apparatus according to a second embodiment of the present invention.

FIG. 6 is a conceptual diagram of a relationship between the arrangement of the discharge ports 101 and the movement direction of the suction nozzle in the liquid discharge apparatus according to the second embodiment.

In the second embodiment, a method of setting a range of the second direction corresponding to the movement direction of the suction nozzle 71 when the suction is performed by the suction nozzle 71 for the discharge ports 101 arranged on the discharge port surface 10 in a staggered pattern as two discharge port arrays is described.

In the second embodiment, the discharge port arrays on the discharge port surface 10 are defined as a first array 101*b* and a second array 101*a*. The suction nozzle 71 is moved in an order of the first array 101*b* and the second array 101*a* to perform the suction operation.

As illustrated in FIG. 6, when viewed in the orthogonal direction (Y), a discharge port b2 on the upstream side is located between two adjacent discharge ports a1 and a2 on the downstream side. The second direction can be set within a range of an angle $\alpha$ defined between a line connecting the discharge port a1 and the discharge port b2 and a line connecting the discharge port a2 and the discharge port b2. When the size of the discharge port 101 is not negligible, the angle $\alpha$ may be adjusted as appropriate depending on the size of the discharge port 101.

When the discharge ports of the plurality of discharge port arrays are arranged at non-overlapping positions in the first direction, the second direction may be set orthogonal to the first direction, or may be set within the range of the angle $\alpha$ including the orthogonal direction.

Through the setting of the second direction within the range of the angle $\alpha$, two or more discharge ports are not arranged in the movement direction of the suction nozzle 71, and the adhering matter generated at the discharge port on the upstream side does not affect the discharge port on the downstream side.

Third Embodiment

Now, a third embodiment of the present invention is described with reference to FIG. 7.

In the third embodiment, similarly to the first embodiment, an ink-jet recording apparatus (hereinafter referred to as "discharge apparatus") is described as an example of the liquid discharge apparatus.

Figure 7:
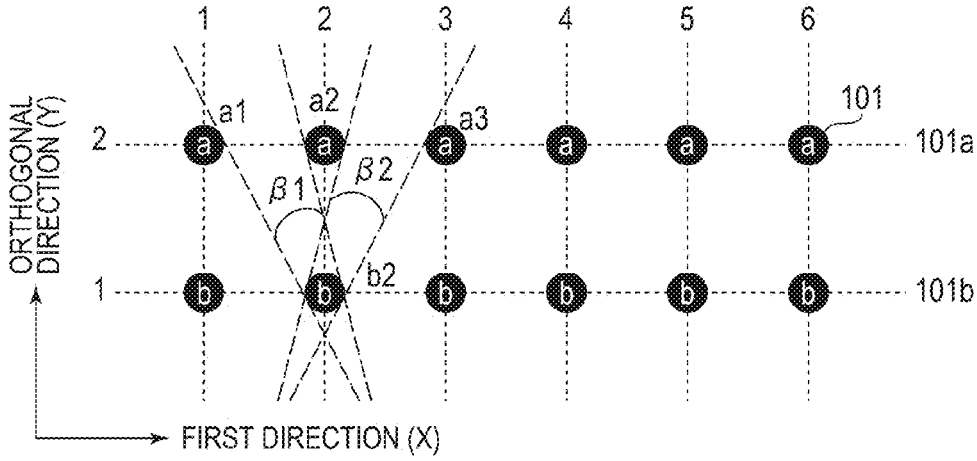
FIG. 7 is a conceptual diagram of a relationship between arrangement of discharge ports and a movement direction of a suction port in a liquid discharge apparatus according to a third embodiment of the present invention.

FIG. 7 is a conceptual diagram of a relationship between the arrangement of the discharge ports and the movement direction of the suction nozzle in the liquid discharge apparatus according to the third embodiment.

In the third embodiment, a method of setting a range of the second direction corresponding to the movement direction of the suction nozzle 71 when the suction is performed by the suction nozzle 71 for the discharge ports 101 arranged on the discharge port surface 10 in a lattice pattern as two discharge port arrays is described.

In the third embodiment, the discharge port arrays on the discharge port surface 10 are defined as a first array 101*b* and a second array 101*a*. The suction nozzle 71 is moved in an order of the first array 101*b* and the second array 101*a* to perform the suction operation.

As illustrated in FIG. 7, when viewed in the orthogonal direction (Y), an discharge port b2 on the upstream side overlaps with an discharge port a2 on the downstream side, and is positioned between discharge ports a1 and a3.

The second direction may be set within a range of an angle β1 defined between a line connecting the discharge port a1 and the discharge port b2 and a line connecting the discharge port a2 and the discharge port b2. Alternatively, the second direction may be set within a range of an angle β2 defined between a line connecting the discharge port a2 and the discharge port b2 and a line connecting the discharge port a3 and the discharge port b2. When the size of the discharge port is not negligible, each of the angles β1 and β2 may be adjusted as appropriate depending on the size of the discharge port 101.

When the discharge ports of the plurality of discharge port arrays are arranged at overlapping positions in the first direction, the second direction may be set so as to be inclined with respect to the direction orthogonal to the first direction.

Through the setting of the second direction within the range of the angle β1 or β2, two or more discharge ports are not arranged in the movement direction of the suction nozzle 71, and the adhering matter generated at the discharge port on the upstream side does not affect the discharge port on the downstream side.

Fourth Embodiment

Figure 8:
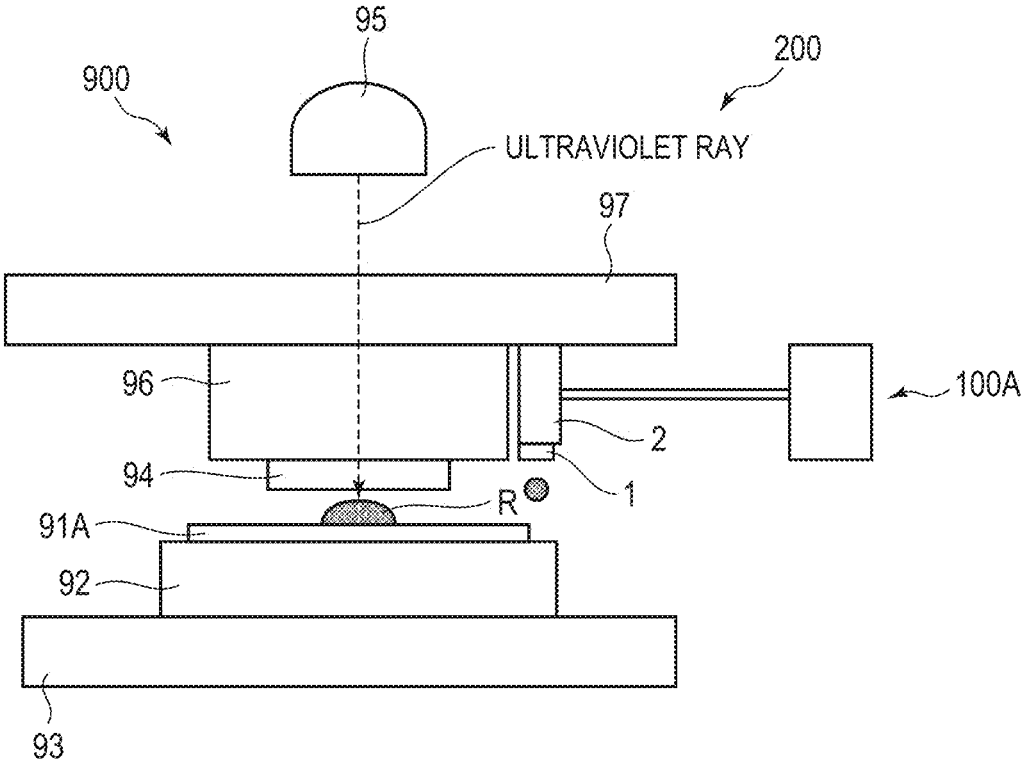
FIG. 8 is a conceptual diagram of an imprint apparatus according to a fourth embodiment of the present invention.
Figure 9:
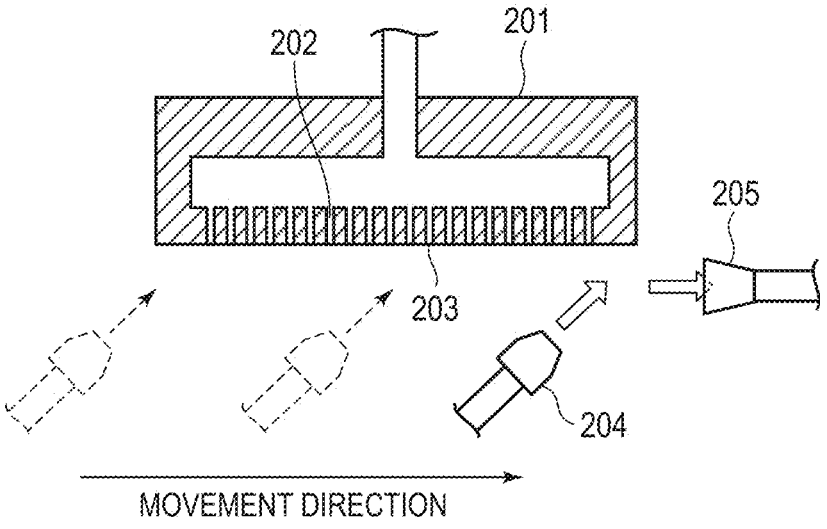
FIG. 9 is an explanatory diagram of a related-art cleaning apparatus for an ink-jet head.
Figure 10A:
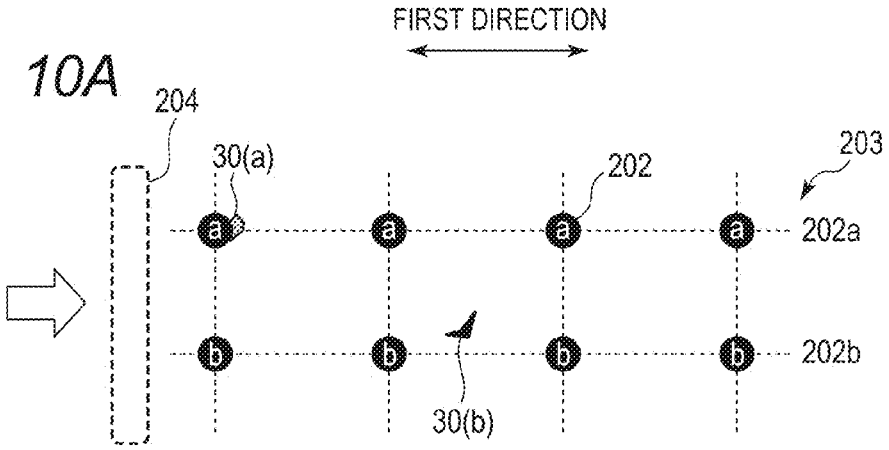
FIG. 10A, FIG. 10B, and FIG. 10C are explanatory diagrams of a related-art cleaning operation.
Figure 10B:
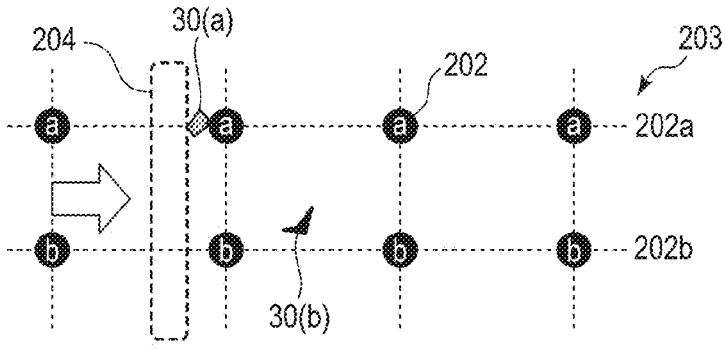
Figure 10C:
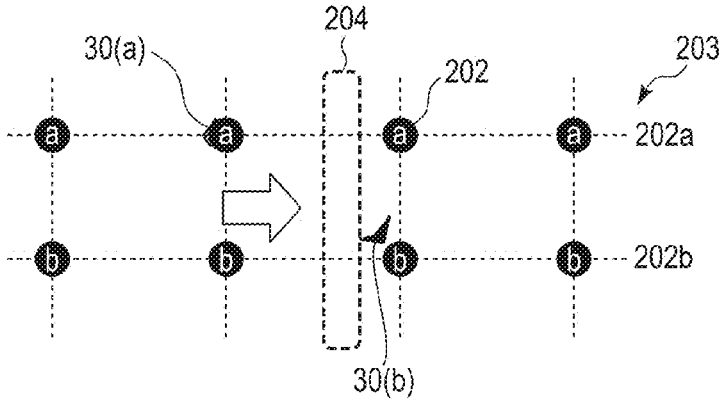

Now, a fourth embodiment of the present invention is described with reference to FIG. 8. FIG. 8 is a conceptual diagram of an imprint apparatus according to the fourth embodiment.

As illustrated in FIG. 8, an imprint apparatus 200 of the present invention mainly includes a liquid discharge apparatus 100A and a patterning portion (patterning unit) 900.

The liquid discharge apparatus 100A basically has the same configuration as that of the discharge apparatus 100 of the first embodiment (see FIG. 1). In the fourth embodiment, the first chamber 21 of the first tank 2 contains photocurable resist, which is discharged to a wafer substrate 91A (substrate) from the head 1 communicating to the first chamber 21. The second chamber 22 is filled with working liquid having a density close to that of the resist.

In the fourth embodiment, the resist is made of a resin having photocurability, but may be made of another substance (liquid) having photocurability. Further, in the fourth embodiment, a monolayer or multilayer film having a thickness of from 10 μm to 200 μm is used as the flexible film 23. The flexible film 23 may have chemical resistance against the resist. For example, a PFA film made of a fluororesin may be used. The flexible film 23 may further have a functional layer for preventing permeation of liquid or gas. Thus, deterioration of the resist in the first chamber 21 or the working liquid in the second chamber 22 can be suppressed. The film having chemical resistance (stability) against the resist and also having a property that liquid or gas is less liable to permeate is suitable as the flexible portion.

The patterning portion 900 mainly includes a mold and an exposure unit (light irradiation unit) 95. The patterning portion 900 further includes a movement unit 96 configured to move the mold 94 vertically.

The mold 94 is held by a first holding portion 97 through intermediation of the movement unit 96. The exposure unit 95 is held by a second holding portion (not shown).

The mold 94 is made of a quartz material having a light transmission property, and a groove-like fine pattern (concavo-convex pattern) is formed on one surface (lower surface) side thereof. The exposure unit 95 is arranged above the mold 94, and is capable of irradiating resist R (pattern) on the wafer substrate 91A through the mold 94 to cure the resist R.

Now, a forming step of forming the pattern of the resist R on the surface of the wafer substrate 91A through use of the imprint apparatus 200 of the fourth embodiment is described. Before the pattern is formed on the surface of the wafer substrate 91A, the discharge port surface 10 of the head 1 may be cleaned in advance as in the above-mentioned respective embodiments. Thus, it is possible to suppress problems such as degradation in patterning accuracy due to the adhering matter adhering onto the discharge port surface and degradation in quality of components (generation of defective products) due to a drop of the adhering matter.

In the fourth embodiment, the upper surface of the wafer substrate 91A having the resist R discharged (applied) thereto with the liquid discharge apparatus 100A and the lower surface of the mold 94 having the concavo-convex pattern formed thereon are brought into abutment against each other. Thus, a pattern corresponding to the concavo-convex pattern formed on the lower surface of the mold is formed on the upper surface of the wafer substrate 91A.

Specifically, the resist is discharged (applied) to the upper surface of the wafer substrate 91A from the head 1 of the liquid discharge apparatus 100A in a predetermined pattern (application step).

After that, the wafer substrate 91A having the resist (pattern) applied (formed) thereto is conveyed to a position below the mold 94 by the conveyance unit 92.

The mold 94 is moved downward by the movement unit 96 so that the lower surface of the mold 94 is pressed against the resist R (pattern) formed on the upper surface of the wafer substrate 91A. Thus, the resist is charged and filled into the groove-like fine pattern forming the concavo-convex pattern on the lower surface of the mold 94 (patterning step).

Under a state in which the resist is filled into the fine pattern, the resist R is irradiated with an ultraviolet ray from the exposure unit 95 through the light transmissive mold 94. Thus, the pattern of the resist is formed on the surface of the wafer substrate 91A (processing step).

After the pattern is formed, the mold 94 is raised by the movement unit 96 so that the mold 94 is separated from the pattern formed on the wafer substrate 91A. The patterning step for the wafer substrate 91A is finished.

Similarly to the first embodiment, in the fourth embodiment, the liquid level in the second tank 3 is set below the discharge port surface 10, and the liquid level adjustment unit (not shown) is capable of adjusting the liquid level in the second tank within a predetermined range (H). Thus, the pressure in the head 1 can be controlled stably within the predetermined range (negative pressure). Further, leakage of the resist (liquid) from the head 1 can be suppressed effectively, and the resist can be discharged from the head 1 stably as well.

When the cleaning operation is performed, the pressure in the head 1 is changed to the positive pressure by the pressure regulation unit 80 (pressure changing unit), thereby being capable of removing the adhering matter adhering onto the discharge port surface more effectively. Thus, the rate of non-defective products can be increased at the time of manufacturing components.

In the fourth embodiment, the internal space of the first tank 2 is filled with the resist and the working liquid having densities close to each other. Therefore, even when any impact occurs in the casing 20, vibration is suppressed effectively. As a result, the effect of the vibration on the pressure in the head 1 is reduced, thereby being capable of stably maintaining the inside of the head 1 in the state of negative pressure.

In the fourth embodiment, the working liquid filled into the second chamber 22 is less liable to be affected by change in ambient temperature and pressure as compared to gas. Thus, even when the ambient temperature and pressure around the imprint apparatus 200 have changed, the volume of the working liquid hardly fluctuates. Therefore, the fluctuation in pressure of the resist in the head 1 communicating to the first chamber 21 is suppressed securely.

The imprint apparatus is applicable to, for example, a semiconductor manufacturing apparatus and a nanoimprint apparatus configured to manufacture semiconductor integrated circuit devices, liquid display devices, MEMS devices, and other devices. As the substrate, a glass plate and a film-like substrate are available in addition to the wafer substrate 91A.

Components can be manufactured through use of the imprint apparatus.

The method of manufacturing a component may include the step of discharging (applying) the resist to the substrate (such as a wafer, a glass plate, or a film-like substrate) through use of the imprint apparatus (head) (application step).

The method of manufacturing a component may further include the patterning step of forming the pattern corresponding to the concavo-convex pattern of the mold on the surface of the substrate by bringing the surface of the substrate having the resist discharged (applied) thereto and the surface of the mold having the concavo-convex pattern formed thereon into abutment against each other.

The method of manufacturing a component may further include a processing step of processing the substrate having the pattern formed thereon. As the processing step of processing the substrate, the method of manufacturing a component may include an etching step of etching the substrate.

When manufacturing patterned media (recording media), optical elements, or other devices (components), processing other than etching may be performed.

According to the method of manufacturing a component of the present invention, as compared to a method of manufacturing a component of the related art, the performance, quality, or productivity of the component can be enhanced, and the production cost can be reduced as well.

The imprint apparatus of the fourth embodiment is also applicable to a semiconductor manufacturing apparatus, a liquid crystal manufacturing apparatus, and other industrial apparatus. In the fourth embodiment, a light source such as a halogen lamp configured to emit an ultraviolet ray containing, for example, i-line or g-line may be used as the exposure unit 95, but a generation apparatus configured to generate other energy (for example, heat) may be used instead.

According to the present invention, the adhering matter on the discharge port surface can be removed efficiently.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-104762, filed May 22, 2015, which is hereby incorporated by reference herein in its entirety.

The invention claimed is:

1. A liquid discharge apparatus, comprising:

a head having a discharge port surface in which a first discharge port array having a plurality of discharge ports configured to discharge liquid arranged along a first direction and a second discharge port array having a plurality of discharge ports configured to discharge liquid arranged along the first direction are provided, wherein the first discharge port array and the second discharge port array are adjacent in a second direction crossing the first direction;

a suction port configured to perform a suction operation for the discharge port surface; and a moving unit configured to cause the suction port to move from a side of the first discharge port array to a side of the second discharge port array in the second direction, in a state in which the suction port is spaced away from the discharge port surface, wherein, when viewed in the second direction, each of the plurality of discharge ports of the second discharge port array does not overlap with each of the plurality of discharge ports of the first discharge port array.

2. A liquid discharge apparatus according to claim 1, wherein the discharge port surface further includes:

a third discharge port array which is adjacent to the second discharge port array in the second direction, and a fourth discharge port array which is adjacent to the third discharge port array in the second direction, and wherein when viewed in the second direction, each of the plurality of discharge ports of the first discharge port array, each of the plurality of discharge ports of the second discharge port array, each of the plurality of discharge ports of the third discharge port array and each of the plurality of discharge ports of the fourth discharge port array does not overlap each other.

3. A liquid discharge apparatus according to claim 1, wherein a length of the suction port is larger than a length of each of the first discharge port array and the second discharge port array.

4. A liquid discharge apparatus according to claim 1, wherein the suction port is configured to suck the liquid from the first discharge port array, and then to suck the liquid from the second discharge port array, and wherein a portion of the suction port, which passes through a position opposed to each of the plurality of discharge ports of the first discharge port array, and a portion of the suction port, which passes through a position opposed to each of the plurality of discharge ports of the second discharge port array, are different from each other.

5. A liquid discharge apparatus according to claim 4, wherein the portion of the suction port, which has passed through the position opposed to the each of the plurality of discharge ports of the first discharge port array, passes through a position other than the position opposed to the each of the plurality of discharge ports of the second discharge port array.

6. A liquid discharge apparatus according to claim 1, wherein the second direction is orthogonal to the first direction.

7. A liquid discharge apparatus according to claim 1, wherein the second direction is angled with respect to a direction orthogonal to the first direction.

8. A liquid discharge apparatus according to claim 1, further comprising a blow port which is disposed behind the suction port in the second direction so as to be inclined toward the discharge port surface, and blows gas to the discharge port surface.

9. A liquid discharge apparatus according to claim 8, further comprising a pressure control unit configured to control a pressure in one of the suction port and the blow port.

10. A liquid discharge apparatus according to claim 1, wherein the moving unit causes the suction port to move in the second direction such that the same portion of the suction port does not pass through regions in front of two or more discharge ports of the the first discharge port array and the second discharge port array in the second direction during suction operation from discharge port array at a front end of a plurality of discharge port arrays in the discharge port surface to a discharge port array at a back end of the plurality of discharge port arrays in the discharge port surface.

11. A liquid discharge apparatus, comprising:

a head having a discharge port surface in which a plurality of discharge port arrays are provided, each discharge port array including a plurality of discharge ports which discharge liquid and are arranged along a first direction;

a suction port configured to perform a suction operation for the discharge port surface; and a moving unit configured to cause the suction port to move in a second direction, which intersects the first direction, in a state in which the suction port is spaced away from the discharge port surface, wherein when viewed in the second direction, each of the plurality of discharge port of the plurality of discharge port arrays does not overlap with each other and wherein the moving unit causes the suction port to move in the second direction such that the same portion of the suction port does not pass through regions in front of two or more discharge ports of the plurality of discharge port arrays in the second direction during suction operation from discharge port array at a front end of a plurality of discharge port arrays in the discharge port surface to a discharge port array at a back end of the plurality of discharge port arrays in the discharge port surface.

12. A liquid discharge apparatus according to claim 11, wherein a length of the suction port is larger than a length of each of the plurality of discharge port arrays.

13. A liquid discharge apparatus according to claim 11, wherein the second direction is orthogonal to the first direction.

14. A liquid discharge apparatus according to claim 11, wherein the second direction is angled with respect to a direction orthogonal to the first direction.

15. A liquid discharge apparatus according to claim 11, further comprising a blow port which is disposed behind the suction port in the second direction so as to be inclined toward the discharge port surface, and blows gas to the discharge port surface.

16. A liquid discharge apparatus according to claim 15, further comprising a pressure control unit configured to control a pressure in one of the suction port and the blow port.

17. A liquid discharge apparatus according to claim 1, further comprising a patterning unit configured to form a pattern corresponding to a concavo-convex pattern of a mold on one surface of a substrate by bringing the one surface of the substrate having the liquid discharged thereto with the head and a surface of the mold having the concavo-convex pattern formed thereon into abutment against each other.

* * * * *